US011536536B1

(12) United States Patent
Metcalf, Jr.

(10) Patent No.: US 11,536,536 B1
(45) Date of Patent: Dec. 27, 2022

(54) TRI SIGHT SYSTEM

(71) Applicant: Terry Neal Metcalf, Jr., Reno, NV (US)

(72) Inventor: Terry Neal Metcalf, Jr., Reno, NV (US)

( * ) Notice: Subject to any disclaimer, the term of this patent is extended or adjusted under 35 U.S.C. 154(b) by 0 days.

(21) Appl. No.: 17/234,586

(22) Filed: Apr. 19, 2021

(51) Int. Cl.
*F41G 1/473* (2006.01)
*F41G 1/02* (2006.01)

(52) U.S. Cl.
CPC ..... *F41G 1/02* (2013.01)

(58) Field of Classification Search
CPC ..... F41G 1/473; F41G 1/02
USPC ..... 42/141
See application file for complete search history.

(56) References Cited

U.S. PATENT DOCUMENTS 1,226,952 A * 5/1917 Dyer ..... F41G 1/473 42/141
2,056,469 A * 10/1936 King ..... F41G 1/473 42/140
2,458,638 A * 1/1949 Pretzer ..... F41G 1/473 42/141
2,730,806 A * 1/1956 Williams ..... F41G 1/473 42/141
7,328,531 B2 * 2/2008 Dietz ..... F41G 1/473 42/133
8,245,433 B1 * 8/2012 Smith ..... F41G 1/44 42/112
8,978,287 B1 * 3/2015 Riley ..... F41G 1/473 42/141
9,816,781 B2 * 11/2017 Waichulis ..... F41G 1/473
2016/0178322 A1 * 6/2016 Albertini ..... F41G 1/473 42/111

* cited by examiner

*Primary Examiner* — Reginald S Tillman, Jr.

(57) ABSTRACT

The Tri Sight System, as the name suggests, utilizes three (3) target sights in a tri-pattern at the end of a barrel of a firearm to improve the shooter's target acquisition and accuracy.

3 Claims, 4 Drawing Sheets

TRI SIGHT SYSTEM

BACKGROUND OF THE INVENTION

This invention (Tri Sight System) is intended to be an improvement over existing gun sights, or gun sight tracking systems, that are mounted at the end of a firearm (long rifle or hand gun) barrel.

Historically, gun sights were originally mounted at the end of barrel, at the 12 o'clock position, and consisted of a bead, or v-shaped wedge, that the shooter would use to aim at a target.

Gun sights, or gun sight tracking systems, have evolved to the use of telescopic or magnifying optical lenses with cross-hairs imbedded on the lens, which are mounted on the barrel near the trigger mechanism that the shooter looks through while aiming at a target at the same 12 o'clock position.

This invention (Tri Sight System) utilizes three (3) target sight positions at the end of a barrel—one at the 12 o'clock position (from the shooter's perspective); one at any point between the 9 o'clock position and the 12 o'clock position, clockwise (from the shooter's perspective); and one at any point between the 3 o'clock position and the 12 o'clock position, counter clockwise (from the shooter's perspective).

Research has not uncovered any other existing patents which utilize a three (3) target sight system at the end of a firearm (long rifle or hand gun) barrel.

SUMMARY OF INVENTION

This invention (Tri Sight System) is an innovative sight, or sight tracking system, which is designed to mount at the end of a barrel of a firearm (long rifle or hand gun), but may be adapted for a bow, cross-bow, or any other type of weapon or product that might use a tracking sight system.

The purpose of this invention is to improve the accuracy of the shooter by providing a new and innovative optical sighting system designed to improve the peripheral vision of the shooter while engaged in the identification, aiming and tracking of a target.

This invention (Tri Sight System) utilizes three (3) target sight positions mounted at the end of a barrel—one at the 12 o'clock position (from the shooter's perspective); one at any point between the 9 o'clock position and the 12 o'clock position, clockwise (from the shooter's perspective); and one at any point between the 3 o'clock position and the 12 o'clock position, counter clockwise (from the shooter's perspective).

DETAILED DESCRIPTION OF THE INVENTION

This invention (Tri Sight System) is an innovative sight, or sight tracking system, which is designed to mount at the end of a barrel of a firearm (long rifle or hand gun), but may be adapted for a bow, cross-bow, or any other type of weapon or product that might use a tracking sight system.

Figure 6:
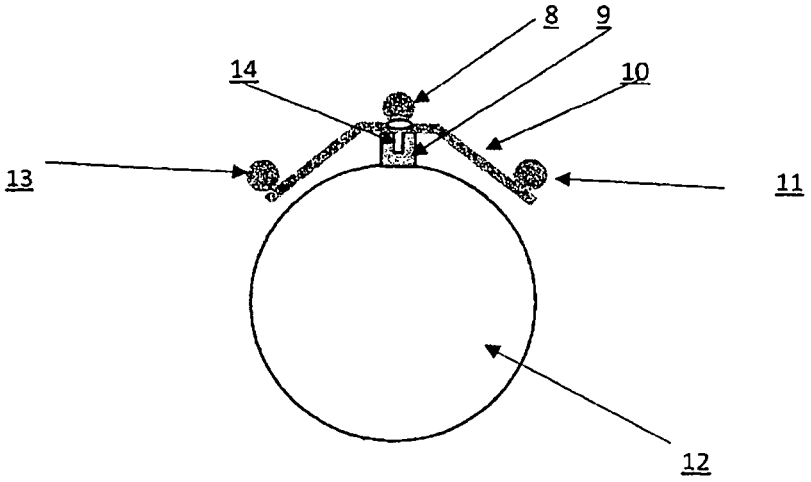
FIG. 6 shows the front view of a firearm barrel showing the tri sight with a bracket that can be attached to the barrel.

The purpose of this invention is to improve the accuracy of the shooter by providing a new and innovative optical sighting system designed to improve the peripheral vision of the shooter while engaged in the identification, aiming and tracking of a target. Referring to FIG. 6 This invention provides the shooter with reference points depending on target direction and location. The uniqueness of this invention is that it augments the 12 o'clock target sight on the barrel of a firearm, which is typically mounted on firearms by manufacturers, by adding two (2) additional target sights on the barrel—one (1) on the left and one (1) on the right—which work in conjunction with the 12 o'clock target sight to converge on the target for better accuracy.

Figure 1:
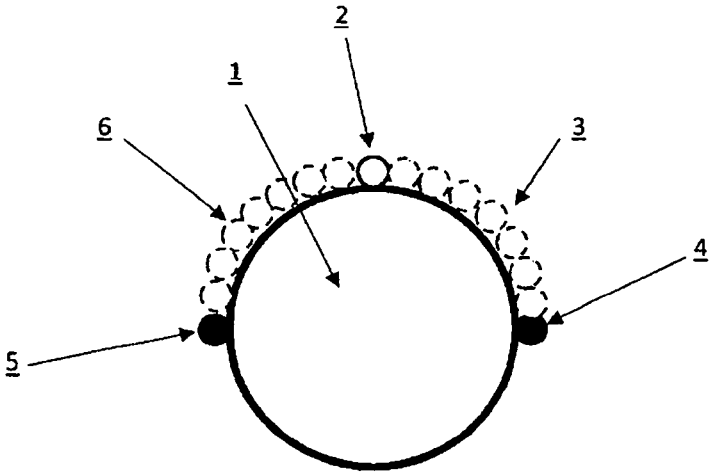
FIG. 1 is the front view of a firearm barrel.
Figure 2:
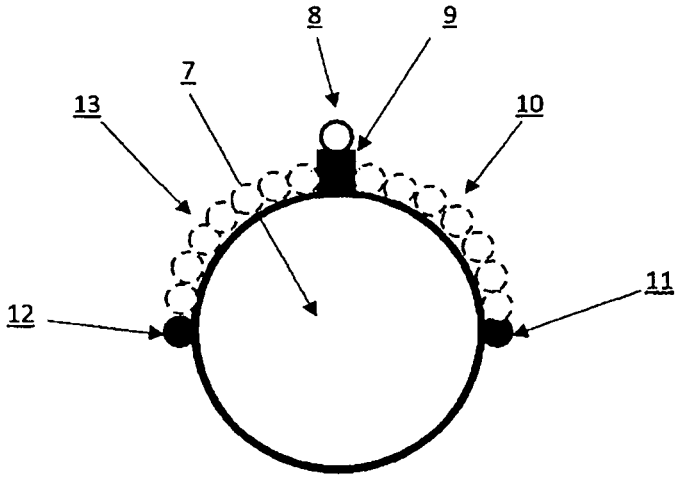
FIG. 2 is the front view of a firearm barrel showing a barrel with a rib.

Referring to FIG. 1 through 2 This invention consists of three (3) target sight positions mounted at the end of a barrel—one at the 12 o'clock position (from the shooter's perspective); one at any point between the 9 o'clock position and the 12 o'clock position, clockwise (from the shooter's perspective); and one at any point between the 3 o'clock position and the 12 o'clock position, counter clockwise (from the shooter's perspective). The target sight at the 12 o'clock position is designed to replace the 12 o'clock target sight provided by the firearm manufacturer.

To put into context, when a target is moving from left to right, the shooter will be able to use the 9 o'clock position to the 12 o'clock position sight to track the target, clockwise, and conversely, when a target is moving from right to left, the shooter will be able to use the 3 o'clock position to the 12 o'clock position to track the target, counter clockwise. These options will improve the shooter's ability to visually track and aim at a stationary or moving target by adding the components of visual contrast, and sky and/or terrain illumination.

Figure 3:
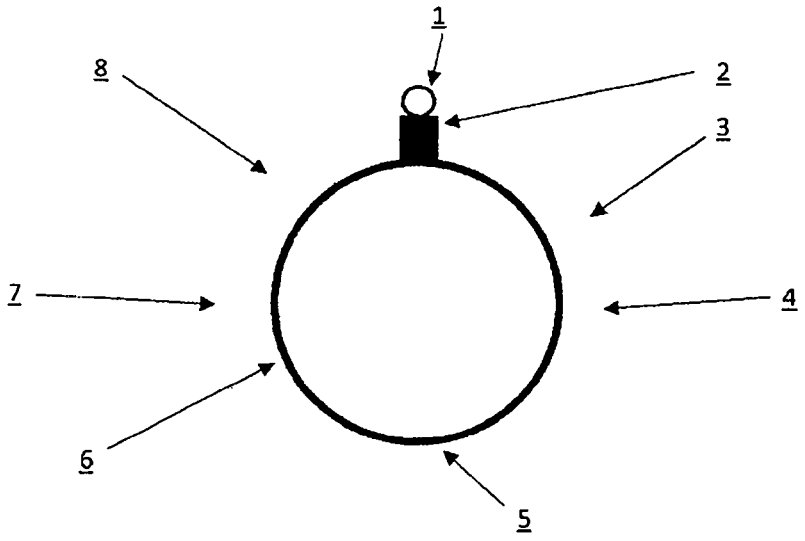
FIG. 3 shows a front view of a firearm barrel and a typical top sight with the grey areas showing the tri sight and it's possible variables.
Figure 5:
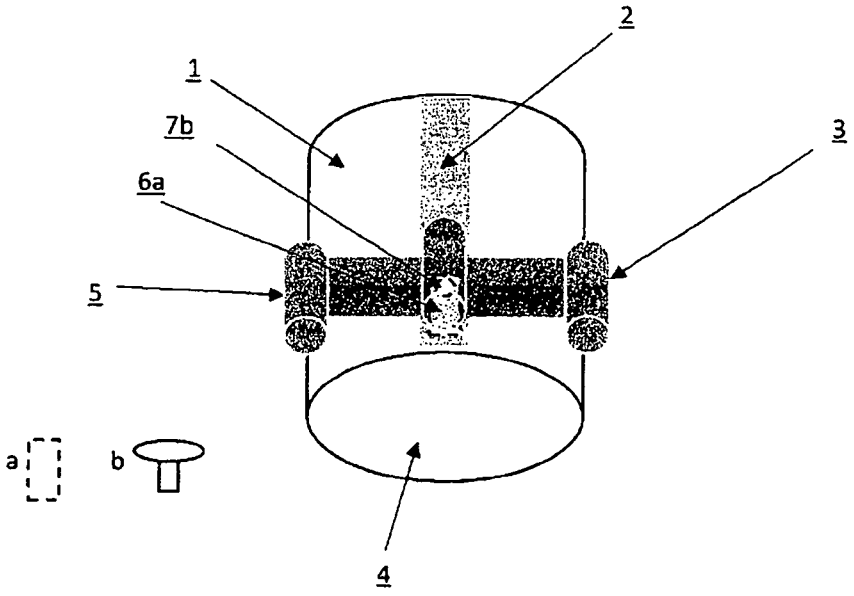
FIG. 5, shows the end of a firearm barrel looking downward at a slight angle.

This invention is designed to be attached at the end of a barrel to a firearm, or weapon, here are a few methods: Referring to FIG. 3 #6 through 4 #14 (1) by fabricating it as a sleeve that slides onto the barrel, over or around the existing aiming sight; Referring to FIG. 5 #7*b* and 6 #14 (2) by removing the existing aiming sight and using the threaded hole on the barrel to attach the invention to the barrel; Referring to FIG. 5 #6*a* (3) by attaching it to the barrel of the firearm, or weapon, by magnet; and/or (4) fabricating the invention to the shape of the barrel, and/or rib, so that it can be locked behind the existing aiming sight. But not limited to these methods separate mounting designs will be offered in differently sized Tri Sight System models that will accommodate many, if not all, firearms available today. For example, the mounting attachment provided will be made available for firearms manufactured with a smooth barrel design, i.e., no rib/rail type, while applying the same improved principal mechanics described herein.

DRAWINGS SHEET NOTES

Page 1 Of 4 FIG. 1 is the front view of a firearm barrel.

Page 1 of 4, FIG. 1, Detail 1 is a depiction of a firearm barrel as if you would be looking straight into the barrel.

Page 1 of 4, FIG. 1, Detail 2 is a depiction of a traditional sight that comes on most if not all firearms in the 12 O clock position.

Page 1 of 4, FIG. 1, Detail 3 is of the variable positions that the tri sight can incorporate showing variants from 9 O clock to 12 O clock from shooters perspective, models can be static or moveable to achieve different variations.

Page 1 of 4, FIG. 1, Detail 4 This shows a fixed location of the 9 O clock position from the shooters perspective which will aid in targeting left to right moving targets.

Page 1 of 4, FIG. 1, Detail 5 This also shows a fixed location of the 3 O clock position from the shooters perspective which will aid in targeting right to left moving targets.

Page 1 of 4, FIG. 1, Detail 6 is of the variable positions from 12 O clock to 3 O clock from the shooter's perspective, this can also be a static position or moveable.

Page 1 of 4 FIG. 2 is the front view of a firearm barrel showing a barrel with a rib.

Page 1 of 4, FIG. 2, Detail 7 Is the same depiction of a firearm barrel as if you were looking straight into the barrel.

Page 1 of 4, FIG. 2, Detail 8 is a depiction of a tradition sight location that comes on most if not all firearms.

Page 1 of 4, FIG. 2, Detail 9 is of what some firearms come with, what is called a ribbed barrel it can be as long as the barrel and it raises of off the actual barrel different firearms have different heights and widths of ribs.

1 of 4, FIG. 2, Detail 10 is of the variable positions that the tri sight can incorporate showing variants from 9 O clock to 12 O clock models can be static or moveable to achieve different variations this shows how it can be incorporated with a ribbed barrel.

Page 1 of 4, FIG. 2, Detail 11 This shows a fixed location of the 9 O clock position.

Page 1 of 4, FIG. 2, Detail 12 This shows a fixed location of the 3 O clock position.

Page 1 of 4, FIG. 2, Detail 13 is of the variable positions that the tri sight can incorporate showing variants from 12 O clock to 9 O clock models can be static or moveable to achieve different variations this shows how it can be incorporated with a ribbed barrel.

Page 2 of 4 FIG. 3 shows a front view of a firearm barrel and a typical top sight with the grey areas showing the tri sight and it's possible variables.

Page 2 of 4, FIG. 3, Detail 1 Is showing the traditional stationary sight on most firearms.

Page 2 of 4, FIG. 3, Detail 2 is of what some firearms come with, what is called a ribbed barrel it can be as long as the barrel and it raises of off the actual barrel different firearms have different heights and widths of ribs.

Page 2 of 4, FIG. 3, Detail 3 This once again shows the different variations from the 9 O clock to the 12 O clock position.

Page 2 of 4, FIG. 3, Detail 4 This shows the fixed position of the 3 O clock Tri Sight which is attached to the sleeve as one part.

Page 2 of 4,FIG. 3, Detail 5 Is the front view of a firearm barrel as you would be looking straight into the barrel.

Page 2 of 4, FIG. 3, Detail 6 is of the sleeve that fits snuggly over 80% of the barrel and is contoured for the rib and barrel it uses the front tradition stationary 12 O clock sight to hold it into position.

Page 2 of 4, FIG. 3, Detail 7 is the 3 O clock Tri Sight that is stationary and molded to the sleeve as one Unit.

Page 2 of 4,FIG. 3, Detail 8 is of the variable positions that the tri sight can incorporate showing variants from 12 O clock to 3 O clock models can be static or moveable to achieve different variations.

Figure 4:
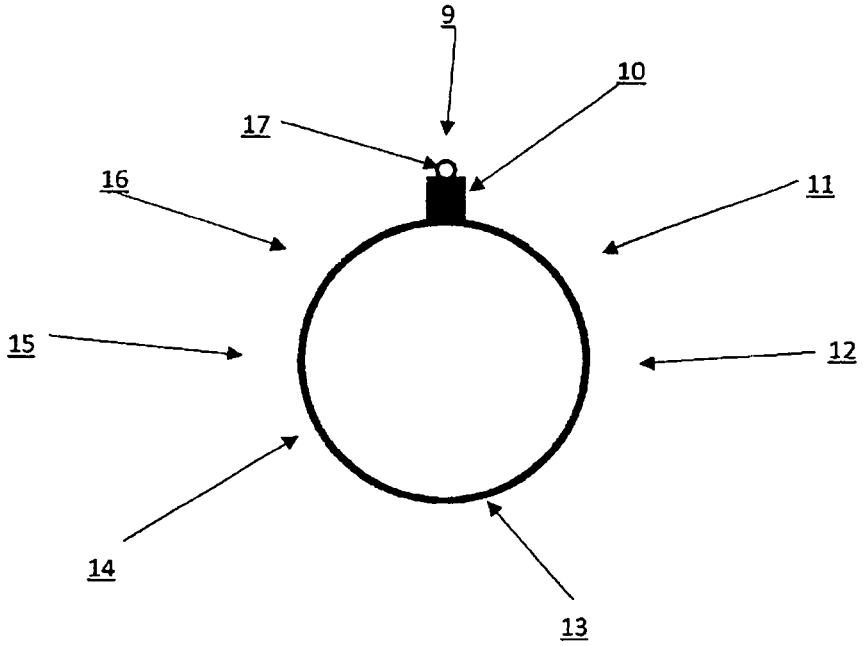
FIG. 4 shows a front view of a firearm barrel and the same typical top sight front view but this figure shows the top sight being replaced by the tri sight.

Page 2 of 4 FIG. 4 Show's a front view of a firearm barrel and the same typical top sight front view but this figure shows the top sight being replaced by the tri sight.

Page 2 of 4, FIG. 4, Detail 9 Is Of the Tri Sight replacing the traditional 12 O clock sight that is commonly applied today it will also be molded to the sleeve as one unit.

Page 2 of 4, FIG. 4, Detail 10 This is once again a repetition of the previous description showing the ribbed Barrel.

Page 2 of 4, FIG. 4, Detail 11 Is the variances of 9 O clock to 12 O clock Position from the shooter's perspective.

Page 2 of 4, FIG. 4, Detail 12 is the fixed Tri Sight at the 9 O clock position it is all one part of the sleeve.

Page 2 of 4, FIG. 4, Detail 13 Is the firearms barrel as you are looking into it.

Page 2 of 4, FIG. 4, Detail 14 is of the sleeve that fits snuggly over 80% of the barrel and is contoured for the rib and barrel it uses the front tradition stationary 12 O clock sight to hold it into position.

Page 2 of 4, FIG. 4, Detail 15 Is the stationary Tri Sight 3 O clock position as part of the sleeve.

Page 3 of 4, FIG. 4, Detail 16 Is the Tri Sights 12 to 3 O clock variables.

Page 3 of 4, FIG. 4, Detail 17 Is the traditional sight being used to hold the sleeve into place also note that the sleeve could possibly be attached with a screw if the traditional sight is removable.

Page 3 of 4 FIG. 5, shows the end of a firearm barrel looking downward at a slight angle.

Page 3 of 4, FIG. 5, Detail 1 is the firearms barrel partial view of the front as you would view it from looking straight down at it.

Page 3 of 4, FIG. 5, Detail 2 Is the rib attached to the barrel also a partial view.

Page 3 of 4, FIG. 5, Detail 3 This shows the Tri sights 9 O clock position.

Page 3 of 4, FIG. 5, Detail 4 This is the front of the opening of the barrel at its ending point.

Page 3 of 4, FIG. 5, Detail 5 This shows the Tri Sights 3 O clock position.

Page 3 of 4, FIG. 5, Detail 6*a* is a way of securing the Tri Sight to the firearm it is a magnetic strip.

Page 3 of 4, FIG. 5, Detail 7*b* this shows another option to secure the Tri sight to the firearm using a screw in the existing tradition sights mounting hole or one could be drilled and tapped.

Page 3 of 4 FIG. 6 shows the front view of a firearm barrel showing the tri sight with a bracket that can be attached to the barrel.

Page 3 of 4, FIG. 6, Detail 8 This is the Tri sights 12 O clock sight that is part of a bracket that would hold all 3 sights 12, 3 and 9 O clock sights and any variable in between.

Page 3 of 4, FIG. 6, Detail 9 Is the rib as you would be looking straight at the barrel.

Page 3 of 4, FIG. 6, Detail 10 is showing the bracket method of attaching the tri sight to the firearm.

Page 3 of 4, FIG. 6, Detail 11 Is showing the Tri Sights approximate 11 O clock sight as a part of the bracket.

Page 3 of 4, FIG. 6, Detail 12 is the front of the barrel as you would be looking into it.

Page 3 of 4, FIG. 6, Detail 13 Is showing the Tri Sights 1 O clock sight as a part of the bracket.

Page 3 of 4, FIG. 6, Detail 14 Is showing the attaching screw as it would thread into the rib also note a magnetic strip could be substituted.

Figure 7:
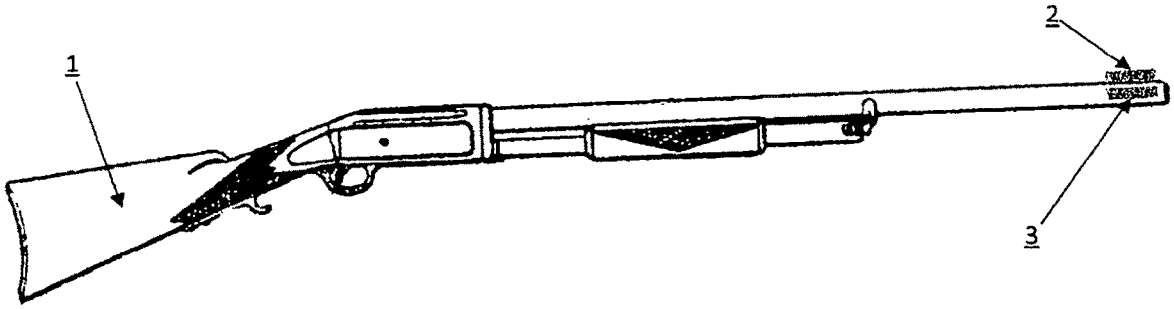
FIG. 7 Shows a typical firearm from the right side and gives a side perspective of the tri sight.

Page 3 of 4 FIG. 7 Show's a typical firearm from the right side and gives a side perspective of the tri sight.

Page 3 of 4, FIG. 7, Detail 1 is a picture of a traditional firearm right side perspective.

Page 3 of 4, FIG. 7, Detail 2 is showing the Tri Sights 12 O clock sight from a right side of the firearm view.

Page 4 of 4, FIG. 7, Detail 3 Is showing the Tri Sights 10 O' clock sight from a right side of the firearm view.

Figure 8:
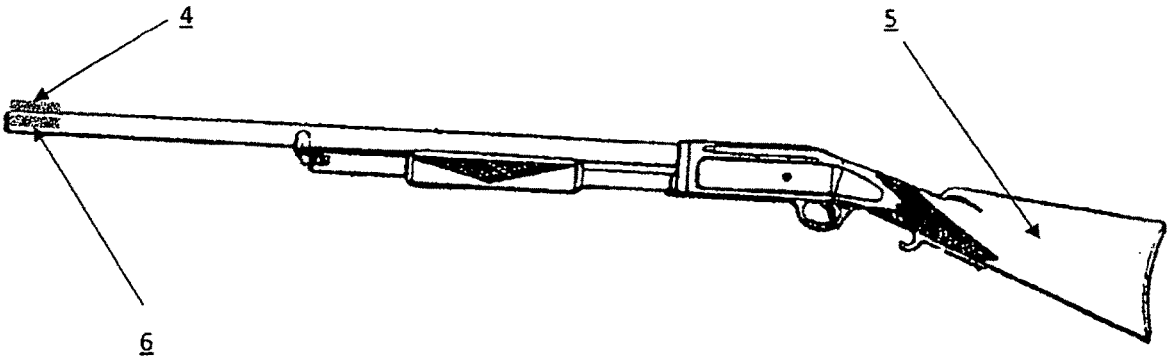
FIG. 8 Show's a traditional firearm from the left side and gives a side perspective of the tri sight.

Page 4 Of 4 FIG. 8 Show's a traditional firearm from the left side and gives a side perspective of the tri sight.

Page 4 of 4, FIG. 8, Detail 4 Is showing the Tri Sights 12 O' clock sight from a left side of the firearm view.

Page 4 of 4, FIG. 8, Detail 5 Is a picture of a traditional firearm left side perspective.

Page 4 of 4, FIG. 8, Detail 6 Is showing the Tri Sights 9 O clock sight position from a left side of firearm view.

The invention claimed is:

1. A tri-sight system for a firearm, the system comprising:

a central portion, the central portion being a flat plate and including a bead sight;

the system further comprising a right portion, the right portion being a flat plate extending from the right side of the central portion and being angled below the horizontal plane of the central portion, the right portion also having a bead sight near the outermost end of the right portion;

the system further comprising a left portion, the left portion being a flat plate extending from the left side of the central portion and being angled below the horizontal plane of the central portion, the left portion also having a bead sight near the outermost end of the right portion;

the tri-sight system being configured to be attached to a rib or barrel of a firearm with either a fastener or a magnet.

2. The system of claim 1 wherein the system is an innovative target sight which utilizes a left and right reference point at the end of the barrel of a firearm to give the shooter two more reference points to correctly acquire quicker target acquisition.

3. The system of claim 2, wherein the two additional reference points will also aid in giving the shooter an elevation reference for correct elevation adjustments.

* * * * *